United States Patent [19]

Frechette

[11] Patent Number: 4,601,068

[45] Date of Patent: Jul. 22, 1986

[54] NURSING GARMENT

[76] Inventor: Doris Frechette, P.O. Box 261, South Dennis, Mass. 02660

[21] Appl. No.: 787,082

[22] Filed: Oct. 15, 1985

[51] Int. Cl.[4] ..... A41D 1/20

[52] U.S. Cl. ..... 2/104

[58] Field of Search ..... 2/104

[56] References Cited

U.S. PATENT DOCUMENTS 1,098,155 5/1914 Knapp ..... 2/104

1,206,480 11/1916 Stagg ..... 2/104

1,309,269 7/1919 Winnegrad ..... 2/104

4,144,593 3/1979 Timmons ..... 2/104

*Primary Examiner*—Doris L. Troutman

*Attorney, Agent, or Firm*—Charles R. Fay

[57] ABSTRACT

A concealment garment for a nursing mother including a body covering top having a pair of parallel spaced slits or openings therein, and an attached collar depending to a point to cover the openings but being free of the top except adjacent the neck portion of the top.

1 Claim, 6 Drawing Figures

NURSING GARMENT

FIELD OF THE INVENTION

Ladies' garment in the form of a top, cape, blouse, etc., especially adapted to child nursing without exposure.

BACKGROUND OF THE INVENTION

While mothers are advised to nurse their babies rather than bottle feed them, women's present day activities are such as to cause public exposure, especially if the mother works, as is usually the case. Some nursing mothers do not object, but nevertheless would prefer to nurse as privately as possible, and others will not nurse under conditions of exposure.

It is the object of this invention to provide a garment in the form of a top, cape, jacket, or blouse, to be worn by the mother, this garment providing concealment of the mother's person, while not interfering with the child's nursing actions. At the same time, the garment forming the present invention looks like more conventional clothing and does not attract undue attention, while appearing to be simply a part of the ensemble.

SUMMARY OF THE DISCLOSURE

The top garment of the present invention provides a tunic that is complete and continuous at the back of the person from neck line to waist or approximately so, while having two spaced vertical slits in front, these slits being access areas for the infant to the mother's breasts. These slits are appropriately closed by catch and hold means of which the well-known Velcro (registered trademark) is an example. This is for the reason that the mother usually holds the child in one hand, thus being essentially onehanded for opening a slit, and this type of fastening is easily managed by one hand, whereas buttons, snaps, etc., even slide fasteners, are not so easily actuated under this circumstance.

The above construction in this case is cooperatively associated with a collar or bib-like member of the same material, that depends from about the neck line or just below to waist level. This collar or bib is like a vest, and covers and hides the slits above described but are free of the garment except at the upper edge or neck where it is connected to the underlying tunic. Because of this cooperation of collar or bib and the slits in the tunic, the child has access to his mother's breasts, but the latter are completely hidden and private and all the public sees is a woman holding her baby, not realizing that she is nursing.

For additional secrecy and ease of handling, the slits are pleated, and the collar or bib is duplicated at the back of the garment so that no emphasis is applied to the collar, etc., at the front. The collar simply appears to be part of the ensemble.

PREFERRED EMBODIMENT OF THE INVENTION

Figure 1:
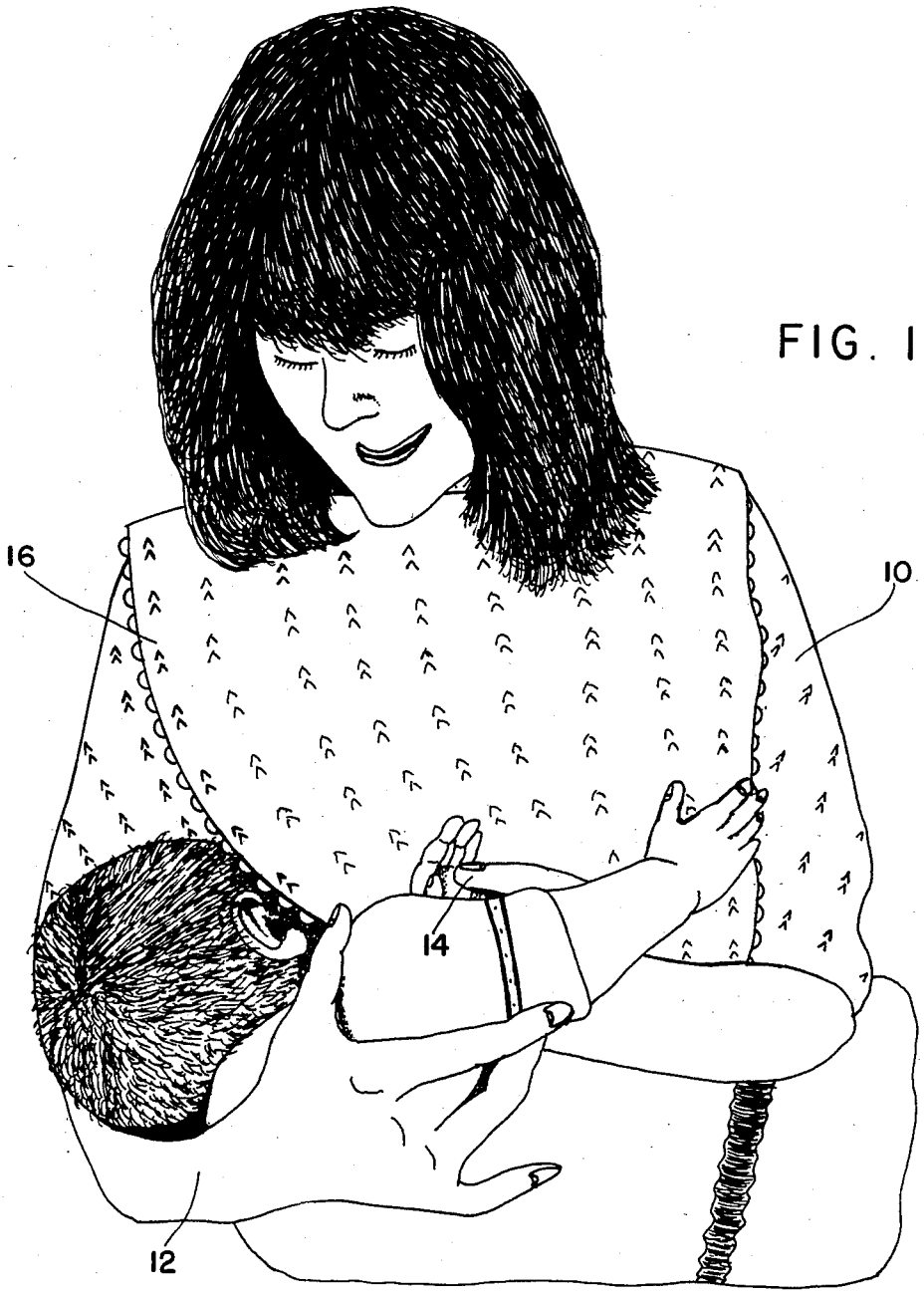
FIG. 1 is a view in front elevation showing the nursing garment in use.

As seen in FIG. 1, the mother 10 holds the baby in her right hand and forearm 12, and the left hand 14 is free to adjust the free-ended collar or bib portion 16, holding it just over the baby's face so the act of nursing is excluded from view. As will be made clear hereinafter, this also provides the mother with easy access to an opening in the body of the garment to fasten and unfasten an opening for the purpose of nursing, and covering the breast at non-feeding periods. It is to be noted that the entire garment is of unitary construction and could be an entire dress, jumper, or anorak type of blouse or the like. In this case, it is referred to as a "top", meaning that it is a complete garment, clothing the upper part or torso of the wearer.

Figure 2:
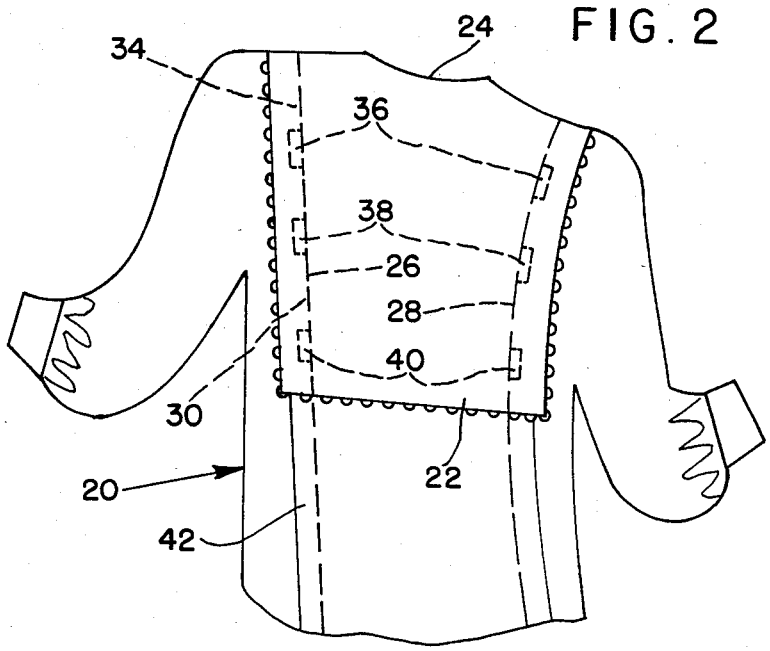
FIG. 2 is a view in front elevation of the garment.

In FIGS.2–6, the top, blouse, tunic, etc. 20, is made of a suitable material, preferably woven and holding a press. The collar, bib, etc. 22, may be made of the same or a different material, and can be integral or secured separately to the top. The top and the collar are a single garment, and may be donned by slipping over the head. The usual garment may have sleeves or half-sleeves, etc., and a neck line, e.g., at 24, at which line the collar and top may be attached and coterminous, but these features may be made differently according to the designer's choice but the top and collar are very desirably a single garment. The top itself extends from the shoulder to cover the hips or may be about hip length, and the collar extends from the shoulder to about waist, but in any case, covers the bust area and is free of the top except at the neck and shoulder line. FIG. 2 illustrates the front aspect, and the top can be free of the collar at the rear of the garment or it can be duplicated for symmetry.

The top itself has two vertical, spaced openings 26,28, which are about twelve inches in length, positioned adjacent the breast areas. These openings are like slits in the garment and are spaced less than the width of the collar 22, being concealed thereby.

Figure 4:
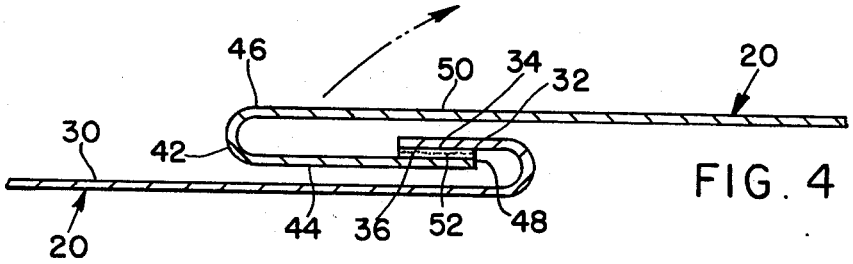
FIG. 4 is a sectional view on a large scale showing the opening closed by the pleat.
Figure 5:
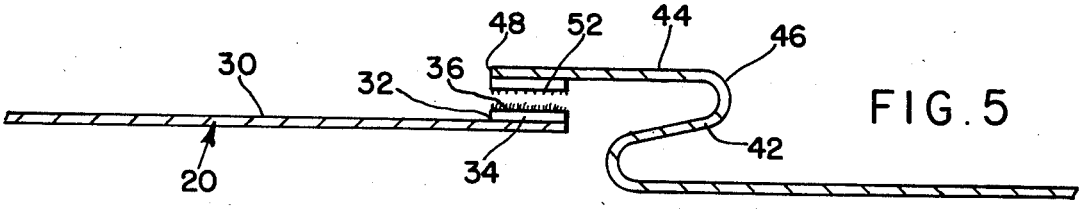
FIG. 5 is a view similar to FIG. 4 but showing the pleat in the act of closing the opening or opening it.
Figure 6:
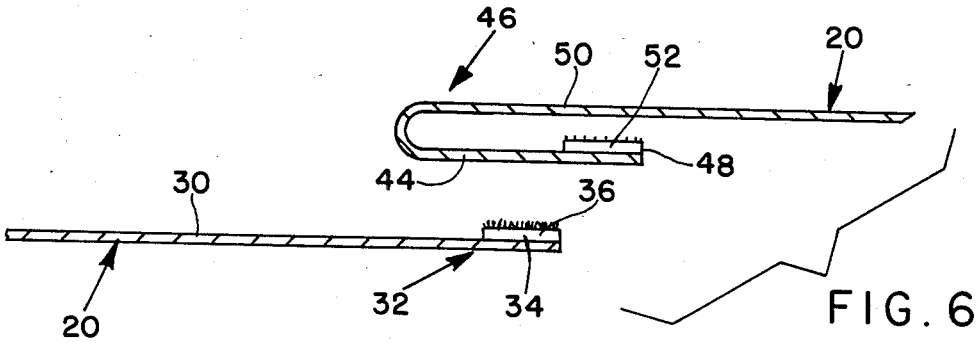
FIG. 6 is a similar view showing the opening fully open.

In FIGS. 4–6, the garment 20 has a portion at 30 bordering the opening 26, and this portion is folded under the hemmed at 32 forming a double thickness at 34. While for purposes of clarity of illustration the layers here and elsewhere are shown slightly spaced, they are in reality in flat contact. Spaced areas of VELCRO, as at 36,38,40, are applied to the upper face of the doubled over or hem area. VELCRO is a registered trademark and exemplifies a hook and loop temporary pressure sensitive connecting material, well-known in the art.

Figure 3:
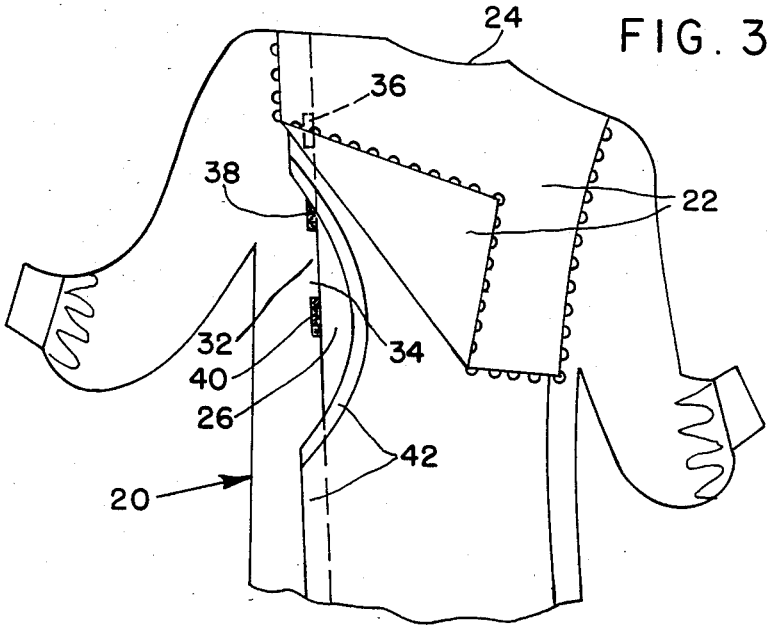
FIG. 3 is a view in front elevation of the garment with an opening in open condition, the collar being folded back to show this.

The other side of the opening 26, FIG. 3, as at 42, is formed as a pleat in the material of the top, and normally overlies the hemmed edge 34. Although the opening may be only about twelve inches in length, the pleat conveniently extends the length of the top as shown. In its normal open position, the pleat appears as in FIG. 6, being doubled as at 44 with a line of stitching at 46. The edge 48 of the foldover 44 is free, but closely faces and flatly engages the underside of the main body portion of the top 20 as at 50. The foldover 44 has VELCRO or the like 52 thereon at the inside or upper face thereof to match the same at 36.

In FIG. 1, the slit is open and the act of nursing is concealed by the collar, and also by the pleat 42. In FIGS. 3 and 6, the slit is open. In FIG. 4, the slit is closed by reason of the connections of the hook and loop material and the pleat overlies the edges 34,36. However, because of the construction, the mother can hold the baby by the right hand and arm, and at the same time, use her left hand to grasp the pleat 42 and pull to the left to disengage the fastening. This is illustrated in FIG. 5 wherein the pleat is essentially pivoted in a clockwise manner and it acts like a handle to pull the pleat away from the connection 36 to open the slit 26 under the collar. The latter is shown pulled back in FIG. 5, but this is for clarity of illustration and will not ordinarily be done in opening and refastening the opening.

When the opening 26 is reclosed, the pleat is simply pressed to the material 36, again as shown in FIG. 5, and when manually released, automatically returns to FIG. 4 condition causing the entire hem at 34 to move counterclockwise. This action is inherent because of the quality of the fabric of which the garment is made and the presence of the stitching at 32, and also at 46.

I claim:

1. A garment for use by a woman while nursing a child for covering the face of the child and concealing the woman's breasts while the child is nursing, comprising a torso-covering top, said top including a front portion covering the upper front torso of the wearer, a pair of pleats in said front portion, said pleats extending longitudinally substantially the length of said front portion, one pleat being located on one side of said front portion to normally extend vertically over one of the breasts of the wearer, and the other pleat being located on the opposite side of said front to normally extend vertically over the other breast of the wearer, a pair of vertical openings in the top in the front portion thereof, said openings being located in said pleats to extend vertically over the wearer's breasts, each of said pleats comprising an inner longitudinal fold and an outer longitudinal fold, each fold having inner and outer garment layers, the outer layer of said inner longitudinal fold being common to the inner layer of said outer fold, said outer longitudinal fold being spaced laterally outwardly from and covering said inner longitudinal fold, each of said vertical openings being formed as a longitudinal slit in said common layer of said folds adjacent said inner longitudinal fold and extending vertically a distance from above the breast to below the breast of the wearer, means to close said openings, said means comprising pressure responsive hook and loop attachable and detachable members operable by a single hand, one of said hook and loop attachable and detachable members being located on one portion of the pleat adjacent the opening therein, while the other of said hook and loop attachable and detachable members is located on another separate but cooperating portion of the pleat adjacent the opening, an opening concealing collar depending from a top edge thereof downwardly past the openings to a point below the openings, the collar being secured at its top edge to the top but being otherwise free thereof, said collar extending laterally past said openings and said pleats on opposite sides of said front.

* * * * *